United States Patent [19]

Yamada

[11] Patent Number: 4,478,187

[45] Date of Patent: Oct. 23, 1984

[54] DISTRIBUTION TYPE FUEL INJECTION APPARATUS

[75] Inventor: Keiichi Yamada, Higashimatsuyama, Japan

[73] Assignee: Diesel Kiki Co., Ltd., Japan

[21] Appl. No.: 377,812

[22] Filed: May 13, 1982

[51] Int. Cl.[3] ..... F02M 59/24; F02D 17/00

[52] U.S. Cl. ..... 123/449; 123/503; 123/198 F

[58] Field of Search ..... 123/198 F, 503, 449

[56] References Cited

U.S. PATENT DOCUMENTS

| | | | |
|---|---|---|---|
| 3,741,685 | 6/1973 | Simko | 123/198 F |
| 3,815,563 | 6/1974 | Stinsa | 123/198 F |
| 3,896,779 | 7/1975 | Omori et al. | 123/198 F |
| 3,929,113 | 12/1975 | Kawase et al. | 123/198 F |
| 3,974,810 | 8/1976 | Yajima | 123/198 F |
| 4,150,651 | 4/1979 | Wade et al. | 123/198 F |
| 4,297,979 | 11/1981 | Kamleitner | 123/198 F |
| 4,413,600 | 11/1983 | Yanagawa et al. | 123/503 |

FOREIGN PATENT DOCUMENTS 50736 4/1979 Japan .

*Primary Examiner*—Ira S. Lazarus

*Attorney, Agent, or Firm*—John E. Toupal; Harold G. Jarcho

[57] ABSTRACT

A distributive type fuel injection apparatus including a fuel distribution plunger mounted for rotary and reciprocating motion in a cylinder that defines a fuel pressure chamber, an inlet passage communicating with a fuel reservoir, and a plurality of discharge ports each providing communication between the pressure chamber and a different one of an engine's power cylinders. The plunger defines discharge passages for sequentially registering with the discharge ports and an overflow passage providing communication between the pressure chamber and the fuel reservoir. A control valve automatically closes the overflow passage during certain engine operating conditions and selectively opens the overflow passage during other engine operating conditions in synchronism with the registration between the discharge passages and only predetermined ones of the discharge ports.

9 Claims, 7 Drawing Figures

DISTRIBUTION TYPE FUEL INJECTION APPARATUS

BACKGROUND OF THE INVENTION

1. Field of the Invention

The present invention relates generally to a distributive type fuel injection apparatus for a multi-cylinder Disel engine and, more particularly, to an injection apparatus which fails to inject fuel into specific cylinders during conditions of engine idle at no load.

2. Description of the Prior Art

The distributive type fuel injection apparatus of the general type has been well known, for example, from Japanese Utility Model Application No. 50736/1979 and the like. Such apparatus is shown in FIG. 1 wherein a rotor 9 having vanes 71 is housed internally of the end walls on a casing 4 to form a feed pump 37. The rotor 9 has its shaft 1 synchronously rotated by the engine and a plunger 52 is coupled to the inner end of the shaft 1 by an Oldham's coupling. Encircling the outer periphery of the shaft 1 is a cylindrical holder 29 that is fixed axially but may be rotated slightly. The holder 29 supports cam followers 11 of the same number as the engine's power cylinders by means of circumferentially spaced pins and is controlled in rotation by an injection timing control device 8 engaged through a lever 28.

Coupled to a plunger 52 is a cam disc 27 that is biased by springs (not shown) engaging the cam followers 11, and is reciprocated as the shaft 1 rotates. A cylindrical body 30 is fitted in and secured to an end wall of the casing 4 and is closed by a threaded plug 17. Mounted for rotary and reciprocating movement within the cylindrical body 30 is a fuel distribution plunger that defines therewith a pressure chamber 16. In the peripheral wall of the body 30 is arranged a suction port 15 and discharge ports 19 of the same number as the engine's power cylinders and axially spaced relative to each other. The suction port 15 is connected to a discharge port of the feed pump 37 via the interior of the casing 4. Disposed in circumferentially equally spaced relationship, each of the discharge ports 19 is connected by a valve 6 to an injection valve of a different power cylinder of the engine.

Provided in the outer peripheral surface of the plunger 52 are suction passages 18 of the same number as that of the power cylinders and periodically connecting the suction port 15 and the pressure chamber 16. Also, the plunger 52 is provided with an axial passage 22, one end of which communicates with the pressure chamber 16. A central portion of the passage 22 communicates with a radial discharge passage 20 that sequentially registers with the individual discharge ports 19. The opposite end of the passage 22 periodically communicates with the fuel reservoir formed internally of the casing 4 via a radially extending overflow passage 21.

A control sleeve valve 24 for opening and closing the overflow passage 21 is slidably fitted over the plunger 52. Connected to the control valve 24 by a ball point is the lower end of a start lever 33. The start lever 33 together with a tension lever 67 is pivotally mounted by a pivot pin 66 to the casing 4 and both are resiliently connected to each other for relative pivotal movement through a given angle. An upper end of the start lever 33 is biased and engaged with a push rod 64 by the force of a spring 63 extending between the upper end of the tension lever 67 and an accelerating lever 62. Coupled for rotation with the shaft 1 by a gear mechanism 72 are centrifugal weights 61 which separate to force the push rod 64 rightwardly. In this manner, the control sleeve 24 is moved in an axial direction of the plunger 52 by the operation of the accelerating lever 62 to adjust the level of fuel injection and also is moved by the centrifugal weights 61 to restrain variation in the rotation of the engine.

To reduce exhaust gases from an engine of the above-described type, it has been proposed recently that certain specific cylinders be placed in a non-injection condition when the engine is running at idle while extra fuel be injected into the remaining cylinders to thereby maintain no-load running at a relatively high speed. In that way the engine can operate on a lesser number of cylinders providing a reduction in harmful components of exhaust gases. It is an object of the present invention to provide a distributive type fuel injection apparatus which provides that type of operation.

SUMMARY OF THE INVENTION

A distributive type fuel injection apparatus including a fuel distributive plunger mounted for rotary and reciprocating motion in a cylinder that defines a fuel pressure chamber, an inlet passage communicating with a fuel reservoir, and a plurality of discharge ports each providing communication between the pressure chamber and a different one of an engine's power cylinders. The plunger defines discharge passages for sequentially registering with the discharge ports and an overflow passage providing communication between the pressure chamber and the fuel reservoir. A control valve automatically closes the overflow passage during certain engine operating conditions and selectively opens the overflow passage during other engine operating conditions in synchronism with the registration between the discharge passages and only predetermined ones of the discharge ports.

In a preferred form of the invention, the control valve includes a sleeve mounted for reciprocating and pivotal movement on the pressure plunger and defining radial passages for selective registration with the overflow passage. Pivotal and axial coupling, respectively, control the rotational and axial positions of the valve sleeve so as to selectively incapacitate specific power cylinders.

BRIEF DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENTS

Figure 1:
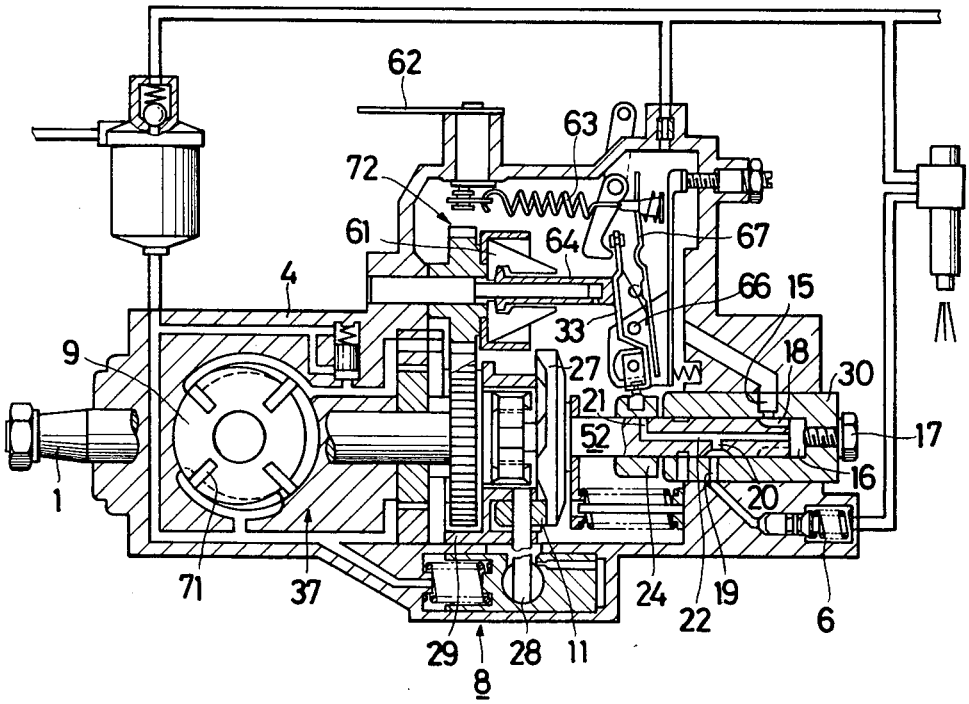
FIG. 1 is a schematic side sectional view showing a conventional distributive type fuel injection apparatus.
Figure 2:
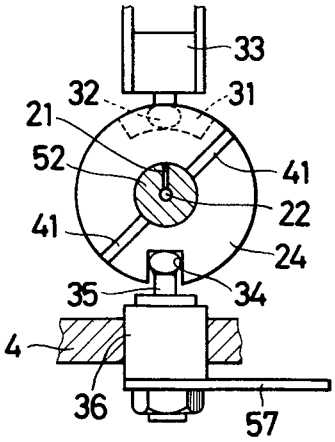
FIG. 2 is a schematic front sectional view of a principal part of a distributive type fuel injection apparatus in accordance with the present invention.
Figure 3:
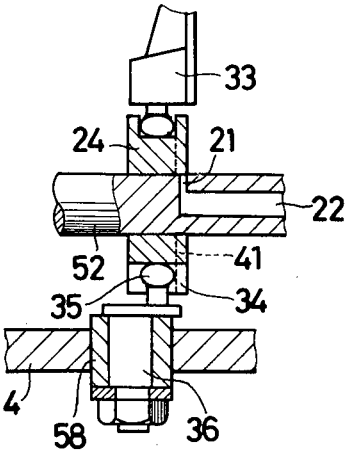
FIG. 3 is a schematic side view of the apparatus shown in FIG. 2.

As shown in FIGS. 2 and 3, the invention consists of a pressure plunger 52 and sleeve valve 24 that are utilized with the fuel injection apparatus shown in FIG. 1. Components similar to those shown in FIG. 1 bear corresponding reference numbers in FIGS. 2 and 3. Similar to the above-described prior art, a plunger 52 is provided with an axial overflow passage portion 22 and a radial discharge passage portion 21 that together connect a pressure chamber 16 and a fuel reservoir formed internally of a casing 4. A circumferential groove 31 is provided in an outer peripheral surface of a control sleeve 24 and an axial coupling including a ball pin 32 on the end of a start lever 33 is slidably engaged therewith. Selective movement of the lever 33 and ball pin 32 establish the axial position of the sleeve 24 with respect to the plunger 52. In addition, an axial groove 34 is provided in the peripheral surface opposite to the groove 31 and a ball pin 35 is slidably engaged therewith. A shaft 36 is rotatably supported on the bottom wall of the casing 4 through a bearing 58 and the ball pin 35 is eccentrically supported on the upper end of the shaft 36. Coupled to the lower end of the shaft 36 is a pivot control lever 57 that controls the rotational position of the control sleeve 24 with respect to the plunger 52. Radial passages 41 are provided in an end surface of the control sleeve 24. The radial grooves 41 are equal in number to the number of power cylinders that are not to be fired during engine idling.

Figure 4:
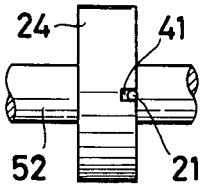
FIG. 4 is a schematic bottom view of the apparatus shown in FIGS. 2 and 3.

During normal loaded engine operation, the arrangement of the radial passages 41 is such as not to register with the overflow passage 21 and provide communication therebetween. However, at engine idle, the shaft 36 is rotated by the lever 57 rotating the control sleeve 24 about the plunger 52 into a rotational position in which the overflow passage 21 registers with the grooves 41 synchronously with the registration of alternate discharge ports 19 with the discharge passage 20. Thus, alternate power cylinders do not receive fuel injection. As shown in FIG. 4, when the plunger 52 is moved into a pressure-feed stroke from the most retracted position thereof, the overflow passage 21 is just in registration with the passages 41, whereby the pressure-feed of fuel is discharged into the fuel reservoir rather than being injected into a power cylinder.

Figure 5:
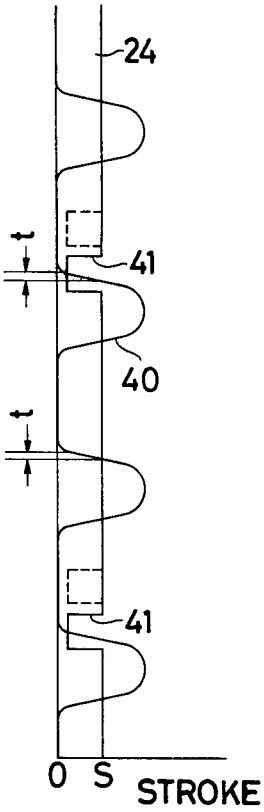
FIG. 5 is a schematic diagram illustrating the operation of the apparatus shown in FIGS. 2 and 3.

Diagrammed in FIG. 5 is the operation of a four-cylinder engine for which two grooves 41 are provided in the control sleeve 24. Each revolution of the shaft 1 produces one revolution and four feed strokes of the plunger 52 as shown by the line 40 which is the locus of the passage 21. The plunger 52 is axially moved through the stroke (s) during the time (t) to feed fuel under pressure. However, during such a period, the grooves 41 synchronously register with the overflow passage 21 so that two power cylinders out of four are not fired. In the event the lever 57 is returned to its original position for loaded engine operation, the grooves 41 of the control sleeve 24 assume the positions shown by the broken lines, in which case, the overflow passage 21 and grooves 41 do not synchronously register and fuel is fed under pressure to all four cylinders.

Figure 6:
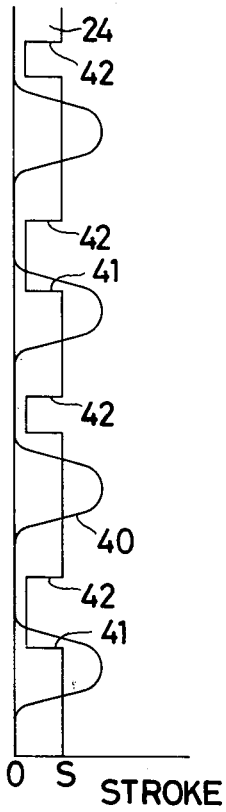
FIGS. 6 and 7 are respectively schematic diagrams illustrating the operation of second and third embodiments of the present invention.

In the FIG. 6 embodiment, four additional radial passages 42 are provided in a peripherally equally spaced relation in the end surface of the control sleeve 24. Two of these passages 42 join with the passages 41 shown in FIG. 5. If the lever 57 is rotated through a required angle during engine idling periods, cylinder-reduction running is achieved as with the embodiment shown in FIG. 5. However, if the lever 57 is further rotated to bring the radial passages 42 and overflow passage 21 into synchronous registration, all four cylinders are placed in a non-injection condition to stop the engine.

Figure 7:
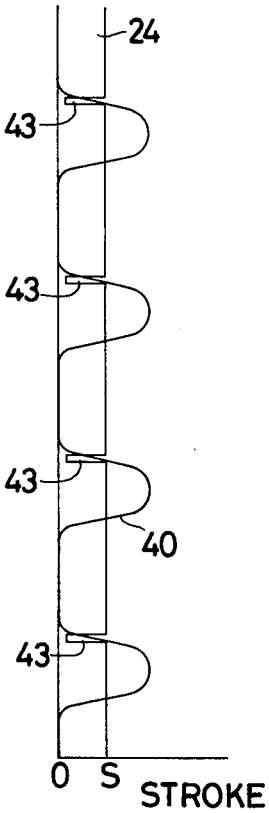

In the FIG. 7 embodiment, the control sleeve 24 is provided with narrow radial passages 43 arranged for registration with the overflow passage 21 during only a limited portion of each plunger stroke. Thus, the rate of fuel feed in a low speed region of the engine is decreased and the injection period can be extended. When fuel in the pressure chamber 16 begins to be forced by the plunger 52, a rapid rise in chamber pressure is restrained during a predetermined period thereby reducing a low engine speed vibrational phenomenon encountered with prior art distributive type fuel injection apparatus.

Obviously, many modifications and variations of the present invention are possible in light of the above teachings. It is to be understood, therefore, that the invention can be practiced otherwise than as specifically described.

What is claimed is:

1. An internal combustion engine distributive fuel injection apparatus comprising:

a fuel reservoir;

a cylinder defining a fuel pressure chamber, an inlet passage providing communication between said reservoir and said pressure chamber, and a plurality of discharge ports each providing communication between said chamber and a different one of the engine's power cylinders;

a fuel distribution plunger mounted in said cylinder for rotary and reciprocating motion in response to rotation of an engine's drive shaft coupled thereto, said plunger defining suction passages for periodically providing communication between the chamber and said inlet passage and discharge passage means for sequentially registering with said discharge ports to provide communication between said pressure chamber and said discharge ports, said plunger further defining an overflow passage providing communication between said pressure chamber and said reservoir; and control valve means for automatically closing said overflow passage during certain engine operating conditions, and for selectively opening said overflow passage during other engine operating conditions in synchronism with said registration between said discharge passage means and only predetermined ones of said discharge ports; said control valve means comprising a control sleeve mounted for reciprocating and pivotal movement on said plunger and defining radial passage means for selective registration with said overflow passage, a pivotal coupling for selectively controlling the rotational position of said sleeve relative to said plunger, and an axial coupling for selectively controlling the relative axial positions thereof.

2. An apparatus according to claim 1 wherein during said other operating conditions said control valve means opens said overflow passage in synchronism with registration between said discharge passage and only alternating ones of said registering discharge ports.

3. An apparatus according to claim 1 wherein said overflow passage comprises a longitudinal section communicating with said pressure chamber and a transverse section defining an overflow port in the outer surface of said plunger and periodically closed by said sleeve.

4. An apparatus according to claim 3 wherein during said other operating conditions said control valve means opens said overflow passage in synchronism with registration between said discharge passage and only alternating ones of said registering discharge ports.

5. An apparatus according to claim 1 wherein said control valve means is further adapted during a third operating condition for opening said overflow passage during registration between said discharge passage and all of said discharge ports.

6. An apparatus according to claim 5 wherein said control valve means comprises a control sleeve mounted for reciprocating and pivotal movement on said plunger and defining a plurality of radial passages of different arcuate size for selective registration with said overflow passage, a pivotal coupling for selectively controlling the rotational position of said sleeve relative to said plunger, and an axial coupling for selectively controlling the relative axial positions thereof.

7. An apparatus according to claim 6 wherein said overflow passage comprises a longitudinal section communicating with said pressure chamber and a transverse section defining an overflow port in the outer surface of said plunger and periodically closed by said sleeve.

8. An internal combustion engine distributive fuel injection apparatus comprising:

a fuel reservoir;

a cylinder defining a fuel pressure chamber, an inlet passage providing communication between said reservoir and said pressure chamber, and a plurality of discharge ports each providing communication between said chamber and a different one of the engine's power cylinders;

a fuel distribution plunger mounted in said cylinder for rotary and reciprocating motion in response to rotation of an engine's drive shaft coupled thereto, said plunger defining suction passages for periodically providing communication between said chamber and said inlet passage and discharge passage means for sequentially registering with said discharge ports to provide communication between said pressure chamber and said discharge ports, said plunger further defining an overflow passage providing communication between said pressure chamber and said reservoir; and control valve means for automatically and selectively closing said overflow passage during only a portion of the registration periods between said discharge passage and said discharge ports during certain engine operating conditions, and for automatically maintaining said overflow passage open during the full registration periods thereof during other engine operating conditions; said control valve means comprising a control sleeve mounted for reciprocating and pivotal movement on said plunger and defining radial passage means for selective registration with said overflow passage, a pivotal coupling for selectively controlling the rotational position of said sleeve relative to said plunger, and an axial coupling for selectively controlling the relative axial positions thereof.

9. An apparatus according to claim 8 wherein said overflow passage comprises a longitudinal section communicating with said pressure chamber and a transverse section defining an overflow port in the outer surface of said plunger and periodically closed by said sleeve.

* * * * *